United States Patent [19]

Briar

[11] 4,200,236

[45] Apr. 29, 1980

[54] MOBILE WATER JET SWEEP CLEANER

[75] Inventor: Jack E. Briar, Gardner, Kans.

[73] Assignee: Briar Industries, Inc., Gardner, Kans.

[21] Appl. No.: 942,786

[22] Filed: Sep. 15, 1978

[51] Int. Cl.[2] ..... B05B 15/06

[52] U.S. Cl. ..... 239/532

[58] Field of Search ..... 239/532, 287, 286, 273, 239/279, 280, 281, 536, 550, 557, 566, 567; 56/400.14, 400.17; 15/320, 400, 24, 79, 166

[56] References Cited

U.S. PATENT DOCUMENTS

| | | | |
|---|---|---|---|
| 2,595,933 | 5/1952 | Gilbertsen | 239/287 |
| 3,989,391 | 11/1976 | Thorner | 15/24 |

*Primary Examiner*—James B. Marbert

*Attorney, Agent, or Firm*—Fishburn, Gold & Litman

[57] ABSTRACT

A mobile water jet sweep cleaner for movement over surfaces to be cleaned having a housing with a top wall, depending front and end walls and intermediate ribs with bottom opening notches therein. An elongate spray pipe is positioned in the notches and retained therein by caster structures secured to the housing. A brush is on the housing rearwardly of the spray pipe with end portions extending outwardly of the end walls, the lower ends of the brush being normally spaced slightly from the surface to be cleaned. A pipe means communicates with the spray pipe and extends through an aperture in the brush and is connected to an elongate pipe that extends upwardly and rearwardly forming a handle portion terminating any fitting for connection to a conduit for supply of water under pressure. The handle means has a cut off valve with a slide member operatively connected thereto for opening the cut off valve on forward movement and closing the cut off valve on rearward movement. The plurality of nozzles are arranged along the length of the spray pipe and direct fan shaped sprays downwardly and forwardly at an acute angle to the surface to be cleaned providing high pressure jet sprays to sweep debris from the surface as the device is moved forwardly and lowering of the handle portion and engagement of the brush with the surface providing a scrubbing action.

4 Claims, 6 Drawing Figures

MOBILE WATER JET SWEEP CLEANER

This invention relates to a water jet sweeping device that is mobile and utilizes jet sprays directed at acute angle onto a surface to be swept or cleaned for removing debris therefrom.

The principal objects of the present invention are to provide a mobile water jet sweeping device having a spray pipe with a plurality of nozzles mounted in an open bottom housing with an elongate handle pipe extending upwardly and rearwardly therefrom to be gripped by an operator for moving the device over a surface to be cleaned; to provide such a device wherein the spray pipe is adjacent the front wall of the housing and a brush is mounted in the housing and spaced rearwardly from the spray pipe for a selective scrubbing of a surface to be cleaned, said brush serving as a rear obstruction to any sprays being deflected onto the operator; to provide such a device wherein casters are mounted on the housing substantially under the spray pipe and cooperate with the portions of the housing to retain the spray pipe therein; to provide such a structure wherein the brush has bristles normally spaced slightly from the surface to be cleaned that are engaged therewith by lowering of the handle, said brush extending beyond the ends of the housing for movement close to lateral surfaces such as curbings and the like; to provide such a device wherein pipe means communicates with the spray pipe and extends through an aperture in the brush to aid in retaining the spray pipe and brush positioned in the housing; to provide such a cleaning device wherein the plurality of nozzles spaced along the spray pipe are directed downwardly and forwardly and provide fan shaped jet sprays at an acute angle to a surface to be cleaned with said fan shaped sprays overlapping to contact all of the surface for the length of the housing; and to provide such a cleaning device which is sturdy, efficient in use and particularly well adapted for its intended purpose.

Other objects and advantages of this invention will become apparent from the following description taken in connection with the accompanying drawings wherein are set forth, by way of illustration and example, certain embodiments of the present invention.

The drawings constitute a part of this specification, including exemplary embodiment of the present invention, and illustrate various objects and features of the mobile water jet sweep cleaning device.

Figure 1:
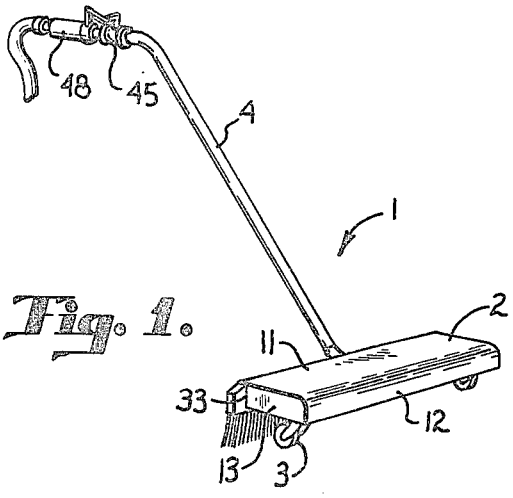
FIG. 1 is a perspective view of a mobile water jet sweep cleaning device embodying the present invention.
Figure 2:
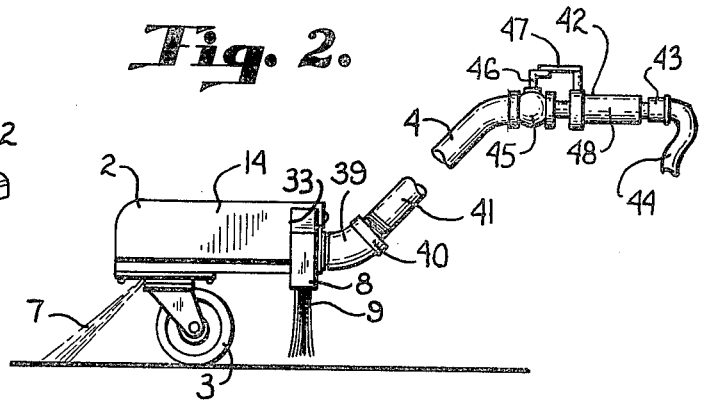
FIG. 2 is a side elevation of the cleaning device.

As required, detailed embodiments of the present invention are disclosed herein. However, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring more in detail to the drawings:

The reference numeral 1 generally designates a mobile water jet sweep cleaning device having a housing 2 movably supported by a suitable rollers or casters 3 and an elongate handle 4 for grasping by an operator for moving the housing over surfaces to be cleaned. A spray pipe 5 with a plurality of nozzles 6 is arranged in the housing to direct a spray as at 7 downwardly and forwardly as the device is moved over the surface to be cleaned. A brush 8 is carried by the rear portion of the housing 2 with bristles 9 adapted to be engaged with the surface to be cleaned providing a scrubbing action thereon. The spray 7 is directed at an acute angle to the surface to be cleaned whereby the jet action tends to clean the surface and force the debris forwardly as the device is moved thereover.

In the structure illustrated the housing 2 has a top wall 11 with a front wall 12 and end walls 13 and 14 depending therefrom. The housing also has pairs 15 of spaced ribs 16 and 17 extending rearwardly from the housing front wall 12. The front wall 12 is thickened between the ribs 16 and 17 and a rib 18 extends between the ribs 16 and 17 to cooperate with the thickened portion of the front wall for mounting of the roller or caster 3 as later described. The ribs 16 and 17 between the front wall 12 and rib 18 have bottom opening notches 19 with a shape to receive the spray pipe 5 therein. In the illustrated structure the spray pipe 5 consists of a tee fitting 20 with pipe sections 21 and 22 connected thereto and extending laterally therefrom. The sections 21 and 22 each have closed ends 23 positioned adjacent the end walls 13 and 14 with the pipe section 21 and 22 being positioned in the notches 19. In the illustrated structure, the caster structures 3 have mounting plates 24 secured by screws 25 to the lower surfaces of the front wall 12 and the rib 18 with the notches 19 arranged relatively thereto whereby the pipe is clamped between the upper end of the notches and the plate 24. The casters have swivel portions 26 carrying depending arms 27 which rotatively mount the rollers 28. The caster structures are preferably adjacent to but spaced from the end walls 13 and 14 to give a wide spacing for the casters and stability to the structure.

In the illustrated structure, the brush 8 is mounted at the rear of the housing 2. The housing is provided with spaced depending flanges 29 and 30 with flange 30 at the rear edge of the housing and the spacing between the flanges adapted to receive the solid block or wood portion 31 of the brush therebetween. The brush is secured to the flanges by suitable fastening devices such as screws 32. It is preferred that the brush have ends extending outwardly relative to the end walls 13 and 14 and therefore in the structure illustrated the end walls terminate as at 33 to engage the brush block 31. The brush ends extend outwardly beyond the end walls 13 and 14 as at 34. The ribs 16 and 17 also terminate in a manner to engage the brush block 31 and add support thereto. The bristles 9 of the brush extend downwardly from the brush block and preferably are normally spaced approximately one fourth inch from the surface to be cleaned for use as later described.

A pipe means 35 is secured to a branch 36 of the tee fitting 20 and the brush block 31 has an aperture 37 through which said pipe means extends. Collars 38 are secured on the pipe means 35 and engage both sides of the brush block 31 for cooperation in providing a rigid strong structure locating and securing the spray pipe and the brush to the housing. A fitting 39 is secured to the rear end of the pipe means 35 and preferably has an internal threaded end 40 for removably attaching an elongate pipe 41. The fitting 39 curves upwardly and is arranged whereby the pipe 41 extends upwardly and rearwardly terminating in a horizontal portion 42 having a fitting 43 on its end adapted to be connected to a conduit 44 for supply of water under pressure. The pipe 41 has a cut off valve 45 mounted therein at the forward portion of the horizontal portion 42 said cut off valve having a control lever 46 connected by a link 47 to a slide member 48 mounted on the horizontal portion of the pipe and adapted to move longitudinally thereof. The slide member 48 forms a handle to be gripped by an operator. Movement of the slide member 48 forwardly moves the valve lever 46 to an on position for flow of water to the spray pipe 5. Movement of the slide member 48 to a rear position moves the valve lever 46 to a off position.

Figure 3:
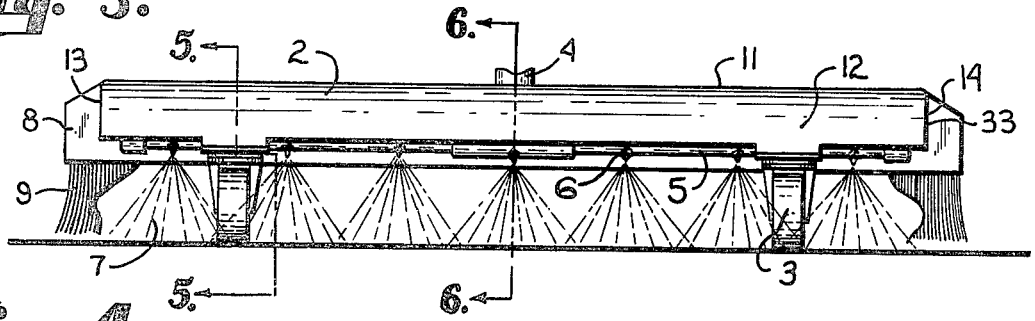
FIG. 3 is a front elevation of the cleaning device with handle and a portion of the brush being omitted.
Figure 4:
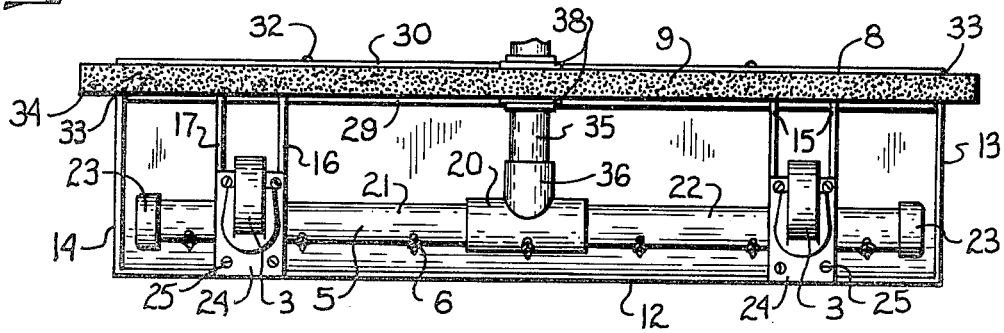
FIG. 4 is a bottom view of the housing portion of the cleaning device showing the spray pipe, casters and brush arrangement therein.
Figure 5:
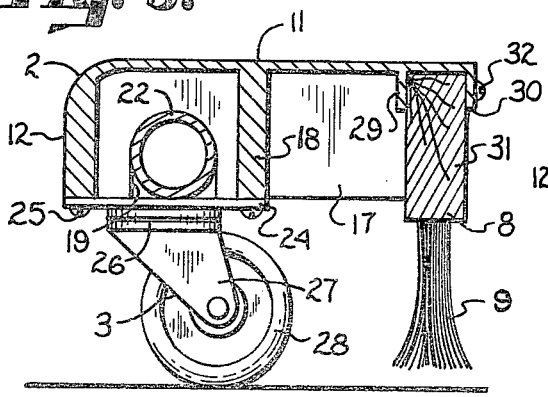
FIG. 5 is an enlarged sectional view taken on the line 5—5, FIG. 3.
Figure 6:
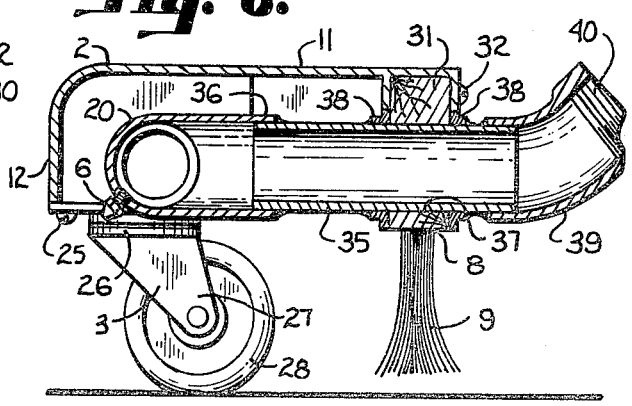
FIG. 6 is an enlarged sectional view taken on the line 6—6, FIG. 3.

The spray pipe 5 has a plurality of nozzles 6 mounted therein and positioned to direct a spray downwardly and forwardly relative thereto. The nozzles are each of a type to provide a fan shaped spray with the wide width of the spray being parallel to the spray pipe. It is preferred that the nozzles direct the fan shaped sprays downwardly at an angle of approximately 40° to the horizontal. As illustrated in FIG. 6 the spray nozzles are spaced from the bottom edge of the front wall sufficiently that the spray is directed thereunder, and as illustrated in FIG. 3 the fan shaped sprays are arranged whereby they overlap adjacent the surface to be cleaned so as to assure impinging of water on the surface for the entire width of the housing.

The separable connection of the pipe 41 with the fitting 39 permits the pipe to be removed and the housing and pipe structure to be stored in a small space. In using a cleaning device constructed as described, the pipe 41 is connected to the fitting 39 and the fitting 43 is connected to a suitable water supply conduit such as a hose connected to a source of water under pressure. With the shut off valve 45 in closed position the structure is moved to an area to be cleaned and is oriented in a position whereby said area is forwardly of the housing 1. Then on forward movement of the operator's hand gripping the slide member 48 the shut off valve 45 is opened and the cleaning device 1 is moved forwardly on the casters 3. The water under pressure is delivered to the spray pipe 5 and discharged through the nozzles 6 in fan jet sprays directed to the surface to be cleaned as the structure is moved forward. Then the operator may move the structure rearwardly by pulling back on the side member 48 which moves the cut off valve to a closed position and the entire structure may be moved rearwardly as desired and then on forward movement the valve 45 is again turned on. With this arrangement the water jet is directed to the surface to be cleaned only as the device is moved forwardly thereby saving water. If the area is difficult to clean due to deposits on the surface the handle structure is depressed to engage the ends of the bristles 9 of the brush 8 with the surface to provide a scrubbing action thereto. Engagement of the brush may be during forward movement or rearward movement or both as desired. The brush ends extending beyond the ends 13 and 14 of the housing 2 permits the device to be moved close to lateral construction such as curbings and the like to assure cleaning of the all of the horizontal surface.

The automatic control of the shut off valve in response to movement of the slide member 48 may be shut off or discontinued as desired by removing the link 47. Then the shut off valve would be operated manually by the lever 46.

While certain forms of the present invention have been described and illustrated, it is not to be limited thereto except insofar as such limitations are included in the following claims.

What is claimed and desired to secure by Letters Patent is:

1. A mobile water jet sweep cleaning device comprising:

(a) an open bottom housing having an integral top wall and depending front and end walls; and pairs of depending laterally spaced walls extending rearwardly from the front wall with said pairs spaced inwardly from each of the end walls and having notches extending upwardly from lower edges thereof;

(b) an elongate spray pipe mounted in said notches and extending horizontally in spaced relation to the front wall, said spray pipe having closed ends adjacent the end walls of the housing;

(c) a plurality of spray nozzles spaced apart on said spray pipe, said nozzles discharging fan shaped jet sprays downwardly and forwardly under the front wall with the long widths of the jet sprays being parallel to the spray pipe;

(d) caster roller structures secured to the pairs of walls closing the notches and retaining the spray pipe in the housing;

(e) a pipe connected to the spray pipe and extending rearwardly and upwardly therefrom and serving as a handle to be grapsed by an operator, said pipe having a cut off valve therein and a fitting for connection to a conduit for supplying water under pressure;

(f) a brush secured to the housing at the rear thereof and having ends extending outwardly relative to end walls of the housing, said brush having downwardly extending bristles terminating in lower ends normally spaced above a surface to be cleaned and engagable with said surface by lowering of the handle pipe for scrubbing the surface.

2. A mobile water jet sweep cleaning apparatus as set forth in claim 1 including:

(a) a water cut off valve in the handle pipe;

(b) a slide member on the handle pipe forwardly of the fitting for connection to a supply conduit;

(c) means operatively connecting the slide to said cut off valve for opening said valve in response to forward movement and closing said valve in response to rearward movement.

3. A mobile water jet sweep cleaning apparatus comprising:

(a) an elongate horizontally disposed spray pipe having closed ends and an intermediate pipe means connected thereto and extending substantially horizontally therefrom and terminating in a fitting;

(b) an elongate spray pipe connected to said fitting and inclined upwardly and away from the spray pipe and serving as a handle to be grasped by an operator, said elongate pipe terminating in a fitting for connection to a conduit for supplying water under pressure;

(c) a mobile housing having a top wall depending front and end walls and depending longitudinal flanges rearwardly of said end walls and casters mounted said mobile housing adjacent to and spaced from said end walls;

(d) means mounting said elongate spray pipe in the housing with said pipe means extending rearwardly therefrom, said closed ends of the spray pipe being adjacent to and inwardly of the housing ends;

(e) a plurality of nozzles mounted on the spray pipe in spaced apart relation and directed forwardly and downwardly, said nozzles providing fan shaped jet sprays with the long width being longitudinally of the spray pipe;

(f) an elongate brush mounted on the housing in rearwardly spaced parallel relation to the spray pipe, said brush having bristles with lower ends in normally spaced relation to a surface to be cleaned, said brush having ends projecting outwardly from the housing ends.

(g) said housing casters being generally under the spray pipe and forwardly of said brush for engaging the brush bristles with a surface to be cleaned in response to a small lowering of the handle pipe;

(h) said brush having an upper portion positioned between said flanges and secured thereto;

(i) said housing having spaced apart depending pairs of ribs extending from the front wall to the foremost of said flanges, said ribs having downwardly opening notches receiving the spray pipe therein;

(j) means securing the caster means on the housing in engagement with said ribs to close the notches and retain the spray pipe therein;

(k) said brush having an aperture through which said pipe means extends with the engagement thereof with the brush facilitating and positioning and holding of the spray pipe in the housing.

4. A mobile water jet sweep cleaning apparatus comprising:

(a) an elongate horizontally disposed spray pipe having closed ends and an intermediate pipe means connected thereto and extending substantially horizontally therefrom and terminating in a fitting;

(b) an elongate spray pipe connected to said fitting and inclined upwardly and away from the spray pipe and serving as a handle to be grasped by an operator, said elongate pipe terminating in a fitting for connection to a conduit for supplying water under pressure;

(c) a mobile housing having a top wall depending front and end walls and depending longitudinal flanges rearwardly of said end walls and casters mounted said mobile housing adjacent to and spaced from said end walls;

(d) said housing having spaced apart depending ribs extending from said front wall to the foremost of said flanges;

(e) means mounting said elongate spray pipe in the housing with said pipe means extending rearwardly therefrom, said closed ends of the spray pipe being adjacent to and inwardly of the housing ends;

(f) a plurality of nozzles mounted on the spray pipe in spaced apart relation and directed forwardly and downwardly, said nozzles providing fan shaped jet sprays with the long width being longitudinally of the spray pipe;

(g) an elongate brush mounted on the housing in rearwardly spaced parallel relation to the spray pipe, said brush having bristles with lower ends in normally spaced relation to a surface to be cleaned;

(h) said housing casters being generally under the spray pipe and forwardly of said brush for engaging the brush bristles with a surface to be cleaned in response to a small lowering of the handle pipe;

(i) said brush having an upper portion positioned between said flanges and secured thereto;

(j) said brush having an aperture through which said pipe means extends with the engagement thereof with the brush facilitating and positioning and holding of the spray pipe in the housing.

* * * * *